US005558250A

United States Patent [19]

Manders

[11] Patent Number: 5,558,250

[45] Date of Patent: Sep. 24, 1996

[54] HAND HELD DEVICE

[76] Inventor: Paulus Manders, 632 Barbadoes Street, Christchurch 8001, New Zealand

[21] Appl. No.: 204,174

[22] PCT Filed: Jul. 5, 1993

[86] PCT No.: PCT/NZ93/00054

§ 371 Date: Dec. 14, 1994

§ 102(e) Date: Dec. 14, 1994

[87] PCT Pub. No.: WO94/01336

PCT Pub. Date: Jan. 20, 1994

[30] Foreign Application Priority Data

Jul. 3, 1992 [NZ] New Zealand ..... 243445

[51] Int. Cl.[6] ..... B65D 35/32

[52] U.S. Cl. ..... 222/99; 222/100

[58] Field of Search ..... 222/99, 100, 101, 222/102, 103, 104, 105, 106, 107

[56] References Cited

U.S. PATENT DOCUMENTS

| | | | |
|---|---|---|---|
| 1,507,393 | 9/1924 | Matias | 222/100 |
| 1,913,759 | 4/1931 | Jacobson et al. | 222/99 |
| 2,492,594 | 12/1949 | Renouf | 222/99 |
| 2,903,162 | 9/1959 | Regan | 222/99 |
| 2,936,006 | 5/1960 | Henley | 222/101 |
| 3,414,166 | 12/1968 | Martin | 222/105 |
| 3,628,696 | 7/1970 | Dulker | 222/99 |
| 4,576,314 | 3/1986 | Elias et al. | 222/99 |
| 5,058,771 | 10/1991 | Curtis | 222/99 |
| 5,094,362 | 3/1992 | Dickens | 222/99 |
| 5,102,014 | 4/1992 | Yanagisawa et al. | 222/100 |
| 5,263,610 | 11/1993 | Okamura et al. | 222/100 |

FOREIGN PATENT DOCUMENTS

| | | | |
|---|---|---|---|
| 1509072 | 11/1966 | France . | |
| 544352 | 2/1932 | Germany | 222/100 |
| 154943 | 11/1938 | Germany | 222/99 |
| 2160210 | 12/1970 | Germany | 222/99 |
| 4338273 | 6/1994 | Germany | 222/100 |
| 489254 | 1/1954 | Italy | 222/99 |
| 475885 | 11/1968 | Switzerland | 222/99 |
| 204929 | 4/1923 | United Kingdom | 222/100 |
| 2071602 | 9/1981 | United Kingdom | 222/100 |

*Primary Examiner*—Andres Kashnikow
*Assistant Examiner*—Lisa Douglas
*Attorney, Agent, or Firm*—Christie, Parker & Hale, LLP

[57] ABSTRACT

A device for use in dispensing the contents of a collapsable tube, the device including a shaped spring clip the ends of which are inserted into the ends of a slotted member so that in use a folded tail of the collapsable tube is inserted into the slotted member, when the slotted member is rotated the spring clip contacts the exterior of the tube forcing it to wrap around the slotted member and if the cap of the tube is removed, material is dispensed from the tube.

11 Claims, 3 Drawing Sheets

HAND HELD DEVICE

BACKGROUND OF THE INVENTION

This invention relates to a device particularly for use in dispensing the contents of a collapsable tube.

collapsable tubes are often not completely emptied before they are disposed of, this is because there can be a great deal of difficulty in removing all of the tube's contents.

There are dispensers and devices available to assist with the removal of the contents from collapsable tubes but these are generally mounted on a wall or if hand held are relatively cumbersome and difficult to use.

SUMMARY OF THE INVENTION

The primary object of this invention is to provide a device which enables the user to dispense the bulk of a material from a collapsable tube, before having to dispose of the tube.

A further object is to provide the consumer with a useful alternative choice.

Further objects and advantages of thus invention will become apparent from the following description which is given by way of example only.

According to the present invention there is provided a device for use in dispensing the contents of a collapsable tube, the device including a shaped spring clip the ends of which are inserted into the ends of a slotted member. When in use, a folded tail of a collapsable tube is inserted into the slot in the member so that when the member is rotated the spring clap contacts the exterior of the tube forcing it to wrap around the member and if the cap of the tube is removed material is dispensed from the tube.

Either or both ends of the member can be knurled or fluted.

The slotted member can be a tubular member and the knurled end or ends can have internally projecting teeth. The teeth of the knurled end/ends act as a ratchet when the member is rotated to inhibit movement of the spring clip. The spring clip holds the collapsable tube in place and releases, under pressure, the contents of the tube.

The spring clip can be configured so that a section of it contacts the member or contacts the exterior of the collapsable tube when it is wrapped around the member. The spring clip can be readily removed from the member.

When the contents of the tube have been dispensed the tube is unwrapped from the member and is disposed of.

The dispensing device can be re-used as often as required.

Further aspects of this invention which should be considered in all its novel aspects will become apparent from the following descriptions which are given by way of example only.

BRIEF DESCRIPTION OF THE DRAWINGS

Examples of the invention will now be described with reference to the accompanying drawings in which.

DETAILED DESCRIPTION

Figure 1:
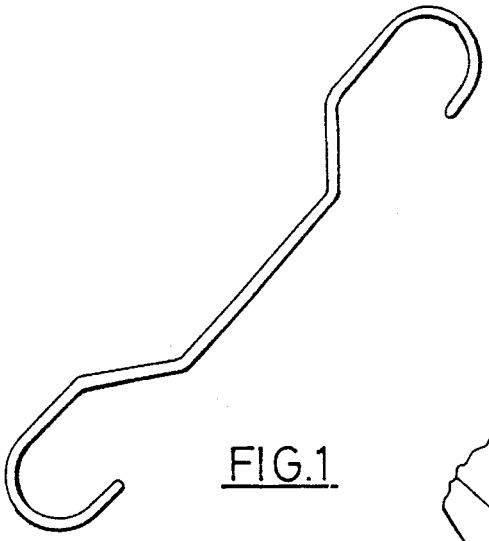
FIG. 1 shows a perspective view of a spring clap for a device according to the invention.

Each of the dispensing devices includes a similar shape of spring clip 1 which is shown in FIG. 1.

Figure 2:
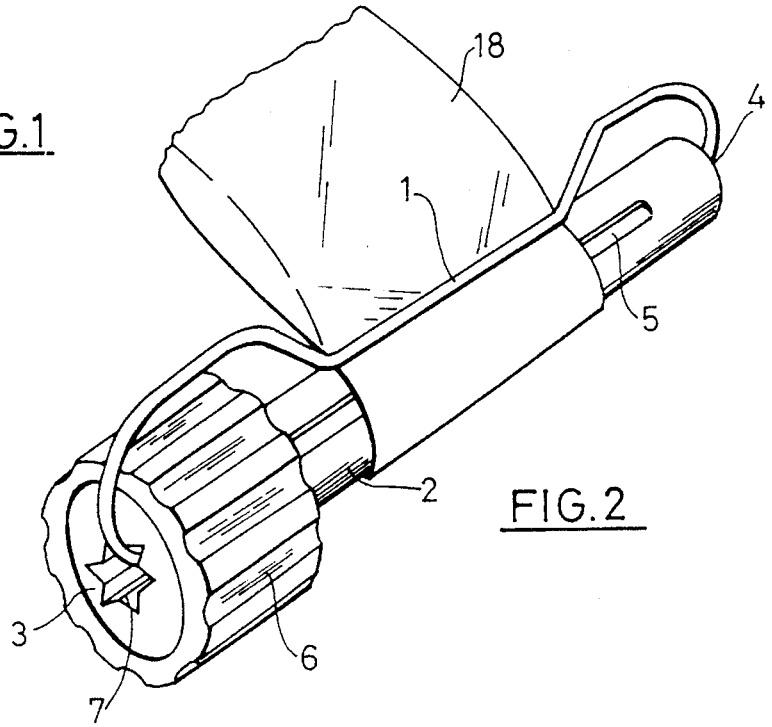
FIG. 2 shows a perspective view of a device according to the invention with a slotted tubular member with a hurled end used in conjunction with a collapsable tube.

In the first example of the device shown in FIG. 2 clip 1 is fitted to the ends 3 & 4 of a tubular member. The tubular member 2 has a slot 5 and has a knurled end 6 as illustrated. Alternatively, as shown in FIG. 3 the tubular member 2 can be constructed from a length of tube with a slot 5.

The folded tail (not shown) of a collapsable tube 18, is inserted into the slot 5 and the hurled end 6 is rotated relative to the spring clip 1 to wrap the collapsable tube 18 around the tubular member 2. As a result of having the collapsable tube 18 wrapped around the tubular member 2 the diameter of the collapsable tube 18 around the tubular member 2 increases and the spring clap 1 engages more firmly with internal teeth 7 in the knurled end 6 to thereby form a ratchet which inhibits movement of the spring clip i relative to the tubular member 2 and prevents the collapsable tube 18 from unwrapping.

Figure 3:
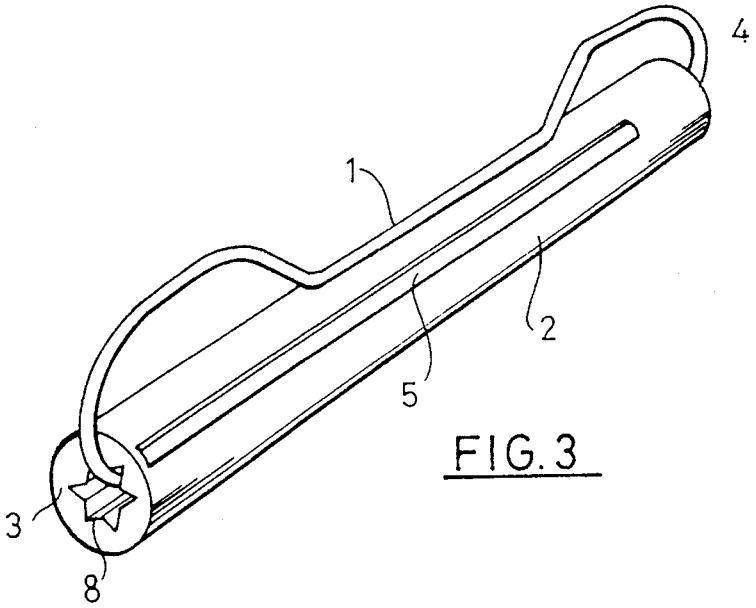
FIG. 3 shows an alternative version of the invention.

Alternatively, the tubular member 2 can have internal teeth 8 as illustrated in FIG. 3.

Figure 4:
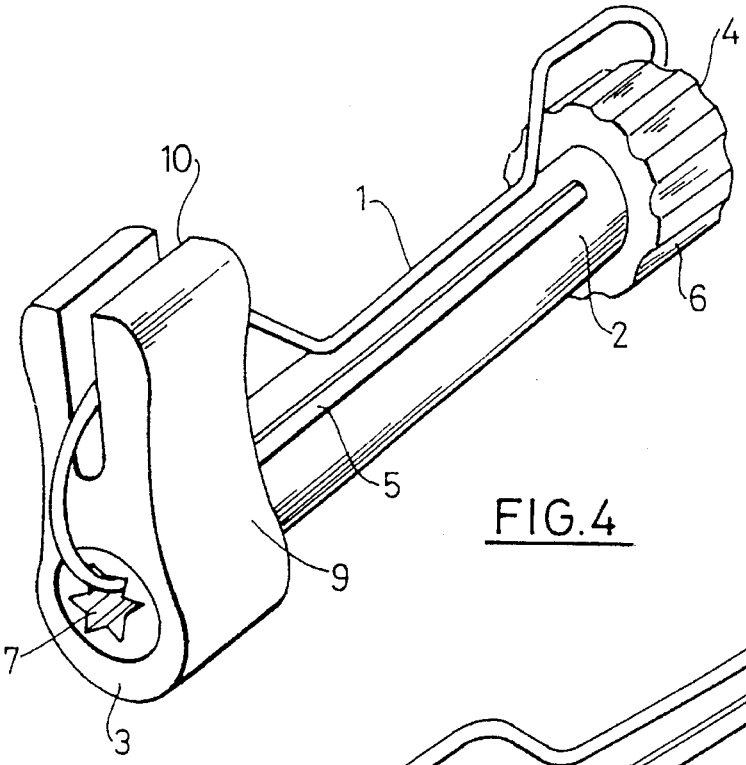
FIG. 4 shows another version of the invention.

As illustrated in FIG. 4 one end of the tubular member 2 can have a separate finger grip section 9 having an elongated slot 10 which helps to maintain the spring clip 1 in place and makes the device easier to use. The finger grip section 9 has an aperture 19, the diameter of which corresponds with the diameter of the tubular member 2. The finger grip section 9 is adapted to be push fitted onto the tubular member 2 and is maintained in position by the spring clip 1 and a ridge of the tubular member 2 which defines one end of an area of increased diameter in the tubular member 2.

Figure 7:
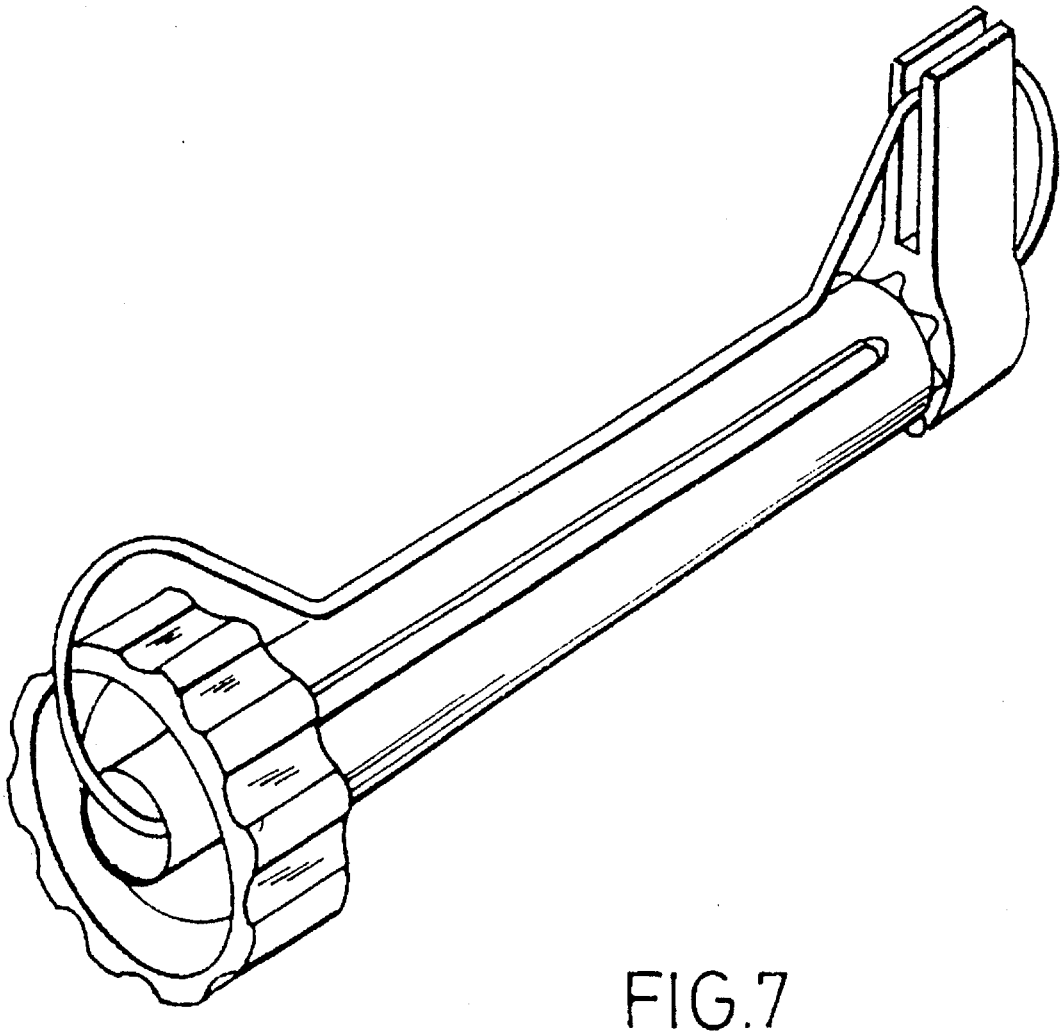
FIG. 7 shows a further version of the invention.

Alternatively, as illustrated in FIG. 7, the finger grip section 9 can have shaped internal teeth 16 formed in the periphery of the aperture 19 in the finger grip section 9. The internal shaped teeth 16 act as a ratchet in conjunction with a pawl 17 which projects from the tubular member 2.

Preferably, when the finger grip section 9 is attached to the end of the tubular member 2, some longitudinal movement of the finger grip section 9 along the tubular member 2 is possible. By pulling the knurled end 6 away from the finger grip section 9 the pawl 17 disengages from the internal shaped teeth 16. Rotation of the hurled end 6 alters the position of the pawl 17 relative to the finger grip section 9 enabling the pawl 17 to rest either on the periphery of the finger grip section 9 or to contact with the internal shaped teeth 16 to prevent rotation of the knurled end 6 relative to the spring clip 2 and prevent the collapsable tube 18 from unwrapping.

Figure 5:
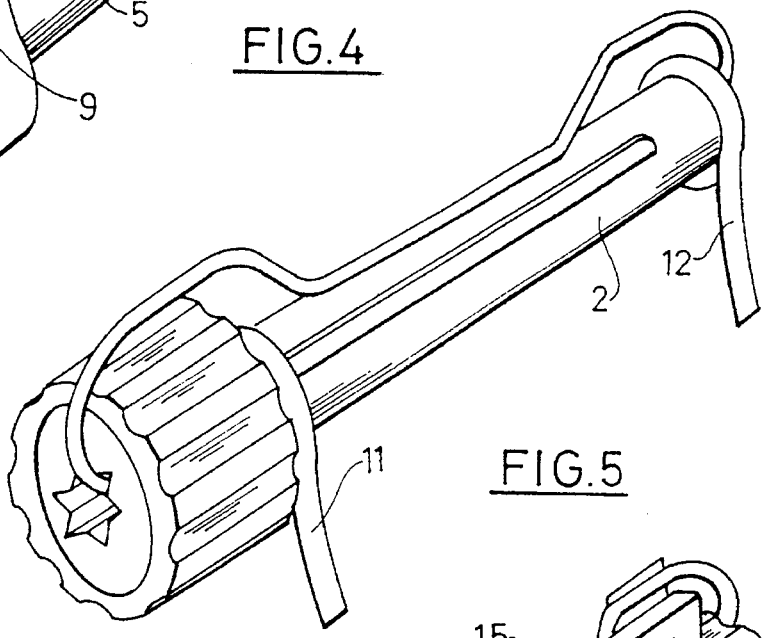
FIG. 5 shows another version of the invention.

Supporting legs 11 and 12, as shown in FIG. 5, can be incorporated and are adapted to be friction fitted to the member 2. These legs 11 & 12 assist in maintaining the device in an upright position on a bench or shelf.

Figure 6:
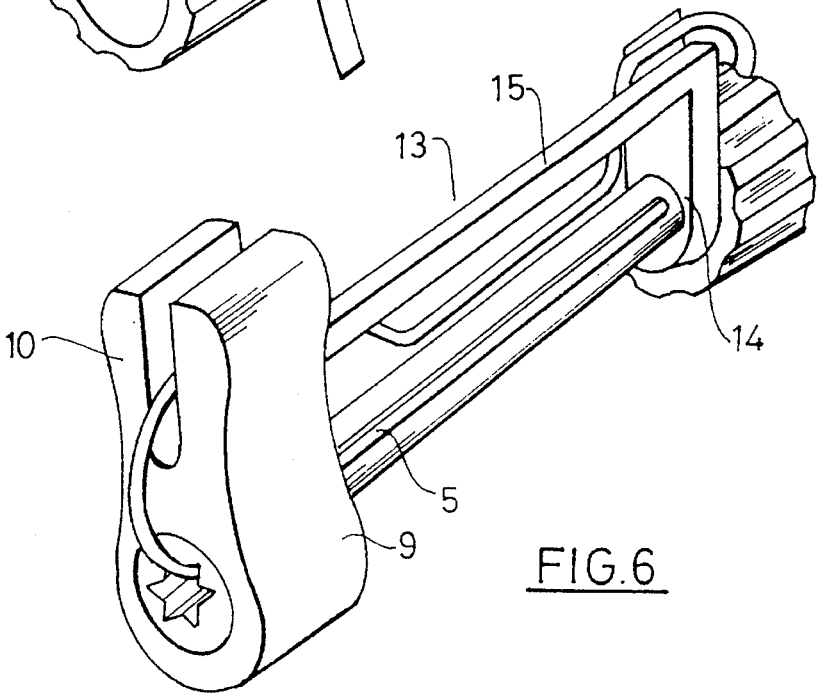
FIG. 6 shows another version of the invention.

In FIG. 6 is shown a transverse guide member 13 which is connected between the finger grip section 9 and a supporting arm 14 at the other end of the device. The transverse guide member 13 can have a guide slot at 15 to enable the collapsable tube 18 to be inserted into the guide slot 15 to direct the folded tail of the collapsable tube 18 into the slot 5.

When used, the device ensures that the bulk of the material contained within the collapsable tube 18 is dispensed. When the collapsable tube 18 has been emptied it is removed from the device by pulling it in a direction away from the device.

Preferably the components of the hand held device, apart from the spring clip, are made of plastic material wherein the components are formed by injection moulding.

The spring clip is preferably made of spring steel and can be chrome plated.

Thus by this invention there is provided a device for dispensing the contents of a collapsable tube and to prevent the collapsable tube from unwrapping.

Particular examples of this invention have been described and it is envisaged that improvements and modifications can take place without departing from the scope of the appended claims.

I claim:

1. A device for use in dispensing the contents of a collapsable tube, the device comprising a shaped spring clip the ends of which are inserted into the ends of a slotted member, in use, a folded tail of a collapsable tube is inserted into the slot in the slotted member so that when the slotted member is rotated the spring clip contacts the exterior of the tube forcing it to wrap around the slotted member and if the cap of the tube is removed, material is dispensed from the tube, and wherein at least one end of the slotted member has internally projecting teeth which act as a ratchet when the slotted member is rotated to inhibit movement of the spring clip relative to the slotted member to prevent the collapsable tube from unwrapping.

2. A device for use in dispensing the contents of a collapsable tube as claimed in claim 1, wherein the spring clap holds the collapsable tube in place and releases under pressure the contents of the tube.

3. A device for use in dispensing the contents of a collapsable tube as claimed in claim 2, wherein the spring clip is configured so than a section of it contacts the member or contacts, when in use, the exterior of the collapsable tube.

4. A device for use in dispensing the contents of a collapsable tube as claimed in claim 3, wherein the sprang clap is readily removable from the slotted member.

5. A device for use in dispensing the contents of a collapsable tube as claimed in claim 3, wherein either or both ends of the slotted member are knurled or fluted.

6. A device for use in dispensing the contents of a collapsable tube as claimed in claim 3, wherein one end of the slotted member has inserted onto one of its ends a finger grip section.

7. A device for use in dispensing the contents of a collapsable tube as claimed in claim 6, wherein the finger grip section has shaped internal teeth, formed in the periphery of an aperture in the finger grip section, the shaped internal teeth act as a ratchet in conjunction with a pawl which projects from the tubular member to prevent rotation of the knurled end when the pawl is engaged with the shaped internal teeth.

8. A device for use in dispensing the contents of a collapsable tube as claimed in claim 7 wherein supporting legs are attached to the slotted member proximate each end of the slotted member.

9. A device for use in dispensing the contents of a collapsable tube as claimed in claim 8, further comprising:

a supporting arm attached proximate the end of the slotted member opposite the finger grip section; and a transverse guide member attached to the finger grip section and the supporting arm.

10. A device for use in dispensing the contents of a collapsable tube, comprising:

a slotted member having first and second ends and an outer surface;

a plurality of internally projecting teeth forming interdental spaces therebetween in the first end of the slotted member; and a spring clip having first and second ends, wherein the first end of the spring clip is mounted in the first end of the slotted member and wherein the second end of the spring clip is mounted on the second end of the slotted member, the mounted spring clip being shaped to exert pressure on the slotted member outer surface, and wherein the spring clip first end is entrapped within an interdental space within the first end of the slotted member for inhibiting rotation of the spring clip relative to the slotted member.

11. A device as recited in claim 10 further comprising a second plurality of internally projecting teeth forming interdental spaces therebetween on the second end of the slotted member, wherein the spring clip second end is entrapped within an interdental space within the second end of the slotted member for inhibiting rotation of the spring clip relative to the slotted member.

* * * * *